United States Patent [19]

Ponce

[11] 4,272,897

[45] Jun. 16, 1981

[54] STEEL SHANK SUPPORT FOR MOLDED UNIT SOLE

[76] Inventor: Gerald J. Ponce, 8956 Burnt Oak Dr., St. Louis, Mo. 63123

[21] Appl. No.: 93,791

[22] Filed: Nov. 13, 1979

[51] Int. Cl.[3] ..... A43B 13/28; A43B 21/36; A43B 13/42

[52] U.S. Cl. ..... 36/24.5; 36/42; 36/76 R

[58] Field of Search ..... 36/24.5, 76 R, 76 C, 36/108, 42, 36 R

[56] References Cited

U.S. PATENT DOCUMENTS

| | | | |
|---|---|---|---|
| 1,934,092 | 11/1933 | Rigante | 36/24.5 |
| 3,091,872 | 6/1963 | Baumann et al. | 36/76 R |
| 4,198,770 | 4/1980 | Mateo | 36/42 |

FOREIGN PATENT DOCUMENTS

| | | | |
|---|---|---|---|
| 1211345 | 3/1960 | France | 36/24.5 |
| 2400857 | 3/1979 | France | 36/24.5 |

*Primary Examiner*—Patrick D. Lawson

*Attorney, Agent, or Firm*—Rogers, Eilers & Howell

[57] ABSTRACT

A shoe shank support suitable for being molded into a unit sole for a ladies high heel shoe provides increased stability and resistance to flexing and comprises a shank of metal strapping sufficiently long to extend from the heel area to approximately the beginning of the ball of the foot and a heel post which extends the height of the heel. The shank may be generally flattened and include a strengthening rib or it may be oval in shape. The heel post is attached to the heel area of the shank by being inserted through a hole and tightened in position by a reversed wing nut. The threaded end of the heel post extends the length of the heel and protrudes a small distance therefrom to provide a mounting for top lifts on the bottom of the heel. Additional holes may be provided in the shank for positioning the shank in a mold and preventing slippage of the shank during the molding process. In a second embodiment, the heel post may be molded into a separate heel unit and secured to a separately molded sole by threading into the wing nut fastener molded into the sole.

9 Claims, 4 Drawing Figures

STEEL SHANK SUPPORT FOR MOLDED UNIT SOLE

BACKGROUND AND SUMMARY

A molded polyurethane or rubber unit sole is often used to construct women's high heel shoes. The molded unit sole forms the outer sole of the shoe and the heel may also be molded into the one piece unit. The upper of the shoe may then be glued, stitched or otherwise secured to the unit sole to provide for the economical manufacture of women's high heel shoes.

The arch and heel area of a unit sole requires bracing and strengthening because the materials used in molding the unit sole are resilient to provide proper cushioning and wear for the outer sole. In a high heeled women's shoe especially, the arch and heel area is subjected to significant pressures and forces tending to flex the shoe in both the heel to toe and the side to side directions. The amount of flex in the unit sole must be limited to avoid ankle injuries and subsequent product liability claims. In the prior art, the usual way of strengthening the unit sole is to insert a 3/16 inch square rod into the mold which extends from approximately half way into the heel and over the top of the arch for about one half the length of the elevated section of the arch. This steel insert is molded in place and does provide some limited amount of rigidity to the heel and top of the arch. However, there is no significant increase in the rigidity from heel to toe or from side to side to reduce the "flex" of the unit sole.

In addition to the "flex" problem inherent in a molded unit sole, cost plays an important part in determining the structure and materials which can be utilized. Because of the high volume production runs in manufacturing shoes, it is very important to constantly find ways to increase the quality of the shoe while reducing the unit price, if possible. A savings of a few pennies on each shoe results in significant savings as over 400 million shoes are purchased by the American shoe industry every year.

Applicant has succeeded in developing a new shank insert for supporting the heel and arch area which provides a markedly increased stability from heel to toe and side to side, extends much further through the unit sole and heel, provides an easy and convenient mounting for a top lift at the bottom of the heel, is significantly reduced in cost, and which provides other advantages as will be described. Applicant's shank support includes a steel shank plate approximately ¾ inch wide and only about 0.065 thousandths thick which extends the full length of the elevated portion of the arch and into the heel area. A strengthening rib is stamped into the length of the steel shank to increase its resistance to twisting and flexing. Alternately, the steel shank may be oval in shape. The steel shank is easily fashioned into different shapes to fit varying styles of unit soles and its generally flattened tongue-like appearance permits it to extend all the way through the entire length of the elevated arch portion of the unit sole where the mold is relatively narrow.

A heel post and fastening member extends downwardly at the rear of the steel shank portion and through the entire height of the heel. The heel post may consist of a case hardened screw with a wing nut reversed and threaded up the heel post to contact the steel shank. The heel post may extend out the bottom of the heel and top lifts for the heel may be screwed onto the heel post and secured into position thereby. Holes may be drilled into the steel shank to aid in positioning the shank during the molding process, as is known in the art.

Applicant's steel shank support also provides a significant cost savings over the prior art device as it may be fashioned from readily available materials such as case hardened steel screws, wing nuts, and sheet steel or strapping. The prior art square rod contains more metal and is more expensive to form into a useable shape. However, very little effort is required to form applicant's steel shank into the proper curvature and it may be rapidly stamped or otherwise inexpensively processed into final form.

Applicant's steel shank support is safer and eliminates the discomfort sometimes experienced with the prior art device as it presents a generally flattened base along the upper edge of the unit sole which does not tend to work its way up towards the bottom of the foot. The 3/16 inch steel shank of the prior art is not flattened and has a tendency to work its way to the top of the molded unit sole if not properly molded or if the shoe is not otherwise properly constructed. In addition, it is well known that consumers are becoming more conscious of potential claims against manufacturers of all sorts of products, including shoes. With applicant's device, increased rigidity and stability is provided in both the heel to toe and side to side directions which significantly reduces the possibility that the ankle would be injured as a result of the shoe failing during use.

These and other advantages of applicant's device may be more fully understood by referring to the drawings and preferred embodiment which follows.

DETAILED DESCRIPTION OF THE PREFERRED EMBODIMENT

Figure 1:
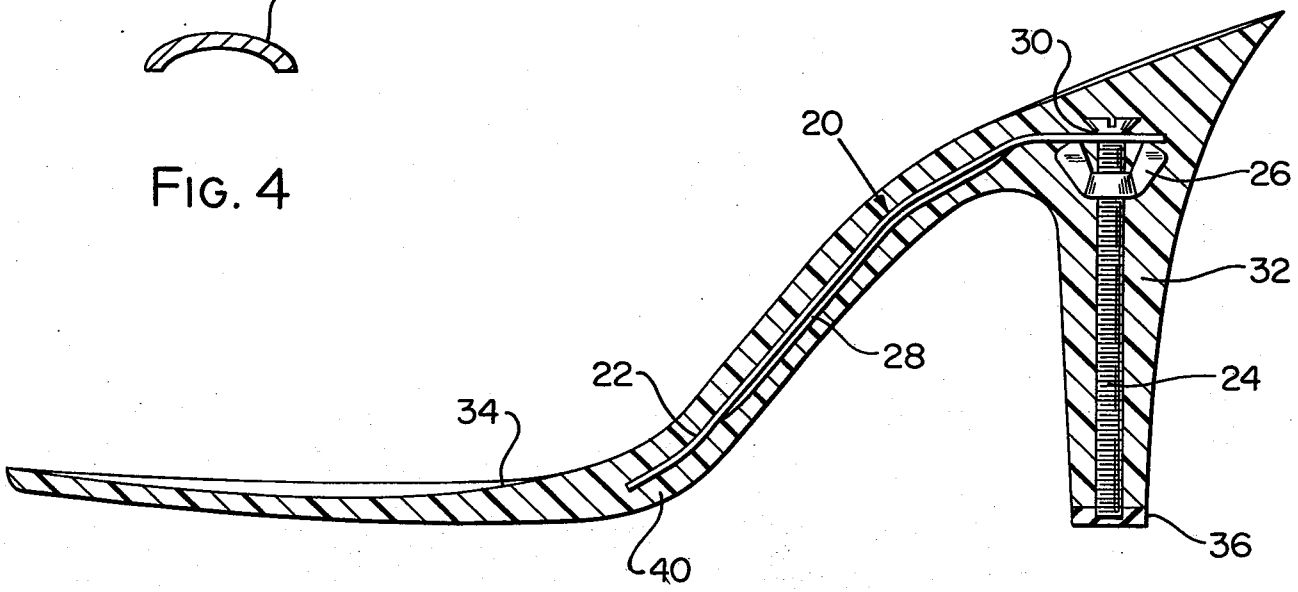
FIG. 1 is a cross-sectional view of a unit sole with applicant's shank support molded in place.
Figure 4:
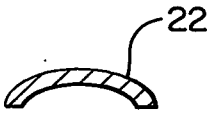
FIG. 4 is a cross-sectional view of an oval shaped shank member.

Applicant's shoe, shank support 20 includes a shank member 22, a heel post 24, and wing nut fastener 26. The shank member 22 may be made of steel or any other suitable metal and formed into a generally flattened strap-like member, as is shown in the drawings. A rib 28 is formed in the approximate center of the shank 22 and extends along its length to add rigidity and further resist twisting or flexing of the shank member 22. Alternately, the shank 22 may be formed into an "oval" or arch shape to increase its rigidity. Other shapes may be used as well, as is known in the art. A fastener hole 30 is formed in the shank 22 appropriately for attaching heel post 24 with wing nut fastener 26 so that it is aligned with the heel 32 of the unit sole 34. Heel post 24 is threaded and extends the length of the heel 32 of the unit sole 34, with its lower end extending beyond the bottom of the heel 32 for the fastening of a top lift 36 thereto. Heel post 24 may consist of a case hardened bolt or the like which is threaded or inserted through fastening hole 30 and wing nut fastener 26 is reverse threaded onto heel post 24 to secure it against shank member 22. As assembled, the shoe shank support 20 is suitable for molding directly into the unit sole 34. To aid in positioning shoe shank support during the molding process, one or more locating holes 38 may be formed in the shank member 22 to maintain the proper spacing of the shoe shank support 20 during the molding process.

Shank member 22 is sufficiently flattened to easily fit within the cross sectional dimension of the unit sole 34 and is sized to extend from just at the beginning of the ball 40 of the unit sole 34 to the heel area 32. Thus, shoe shank support 20 extends along the complete archway of unit sole 34 and, with heel post 24 extending through the length of heel 32, provides a completely rigid and stabilized arch and heel section in the unit sole 34 with increased stability both from heel to toe and side to side. The shank member 22 may be easily stamped out or bent into shape to accommodate different heel height or arch shapes by conventional stamping or forming processes, as is known in the art. In addition, the top lift 36 is completely removable from the unit sole 34 and various types and styles of top lifts 36 may be provided as desired.

Figure 2:
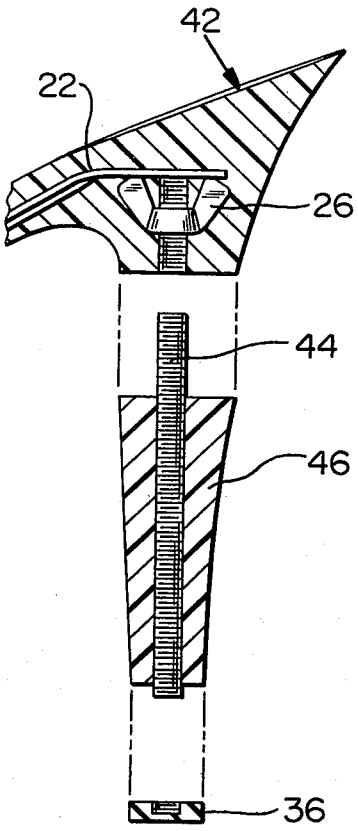
FIG. 2 is an exploded view of an alternate embodiment of applicant's shank support with a separately molded heel unit.
Figure 3:
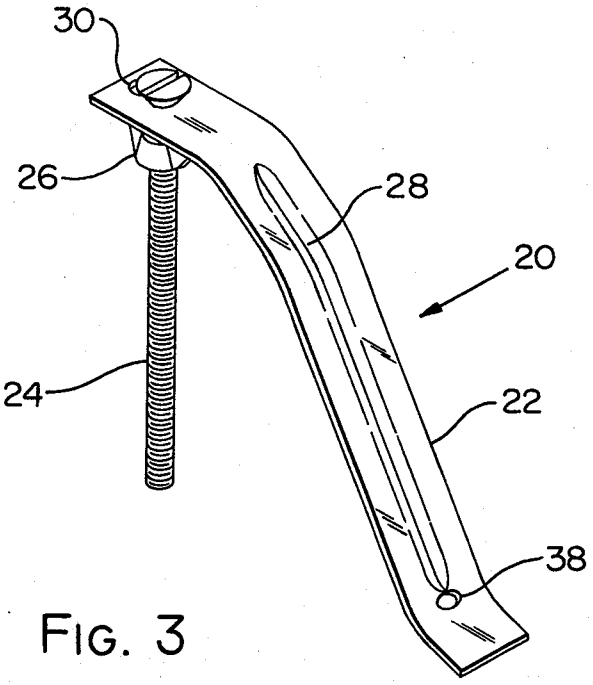
FIG. 3 is a perspective view of applicant's steel shank support with the heel post assembled.

As shown in FIG. 2, applicant's shoe shank support 20 may be molded into a second type of unit sole 42 which has a detached heel 32. In this alternate embodiment, the wing nut fastener 26 may be spot welded or otherwise secured to shank member 22 and then molded in position along with the shank member 22 in unit sole 42. Heel post 44 can then be molded into a heel unit 46 and threaded into the wing nut fastener 26 to secure it to unit sole 42. As in the first embodiment, the lower end of heel post 44 provides the mounting for top lifts 36 at the bottom of the heel unit 46. This greatly increases the versatility of applicant's shoe shank support 20 and the molded unit sole as different materials may be used to mold the heel and sole members with the shank support 20 providing the means to assemble it into a finished unit sole 42. Once assembled, the separately molded unit sole 42 is also provided with the rigidized complete heel and arch support of applicant's first embodiment.

Changes and modifications may be made to applicant's invention and would be apparent to one of ordinary skill in the art. These changes and modifications are included in the teaching of applicant's disclosure and applicant intends that the scope of his invention be limited only by the scope of the claims appended hereto.

What is claimed is:

1. In a molded unit sole for a lady's high heel shoe, a shoe shank support suitable for being molded into said unit sole and which provides stability from side to side and heel to toe comprising a shank of sufficient length to extend from the heel area to approximately the beginning of the ball of the foot, said shank having means defining a hole therein, a detachable heel post for strengthening the heel, said heel post being threaded, and means to fix said heel post within said shank hole including a wing nut for reverse threading onto said heel post.

2. The device of claim 1 wherein the shank has a rib formed therein extending along its length to thereby strengthen same.

3. The device of claim 1 wherein the shank is oval in shape.

4. The device of claim 1 wherein the heel post includes a head of larger diameter than the shank hole.

5. The device of claim 1 further comprising means to mount a top lift to the heel of said unit sole.

6. The device of claim 5 wherein a portion of the heel post extends through the bottom of the heel so that a top lift may be mounted thereto.

7. The device of claim 1 further comprising means defining a hole in the shank for locating the shank support during the molding process.

8. The device of claim 1 wherein the wing nut is secured to the shank, and the unit sole is molded without a heel, said wing nut and shank thereby providing a means to mount a separately molded heel to the unit sole with the heel post.

9. The device of claim 1 wherein the shank is sufficiently flexible to be bent into shape to match the curvature of different unit soles.

* * * * *